United States Patent [19]

Ball

[11] 4,134,456

[45] Jan. 16, 1979

[54] SUB-SEA WELL HEADS

[75] Inventor: Kenneth Ball, Hightown, England

[73] Assignee: Vickers-Intertek Limited, London, England

[21] Appl. No.: 771,357

[22] Filed: Feb. 23, 1977

Related U.S. Application Data

[62] Division of Ser. No. 685,676, May 12, 1976.

[51] Int. Cl.[2] ..... E21B 33/035

[52] U.S. Cl. ..... 166/356; 166/363; 175/7

[58] Field of Search ..... 166/0.5, 0.6, 75 R; 61/69 R, 69 A, 72.3; 175/6, 7

[56] References Cited

U.S. PATENT DOCUMENTS

| | | | |
|---|---|---|---|
| 3,064,735 | 11/1962 | Bauer et al. | 166/0.6 |
| 3,090,437 | 5/1963 | Green | 166/75 |
| 3,211,223 | 10/1965 | Hoch | 166/0.6 |
| 3,318,377 | 5/1967 | Otteman | 166/75 |
| 3,512,583 | 5/1970 | James | 166/0.5 |
| 3,855,806 | 12/1974 | Le Therisien | 166/0.5 |

*Primary Examiner*—Ernest R. Purser

*Attorney, Agent, or Firm*—Scrivener, Parker, Scrivener & Clarke

[57] ABSTRACT

A sub-sea well head comprising a connector and a christmas tree which is enclosed in a capsule is characterized in that a master valve is contained within a member forming the foot of the christmas tree, the member penetrating and being sealed into the bottom of the capsule and supporting the capsule, and in that the master valve is contained within a part of the member within the capsule.

1 Claim, 2 Drawing Figures

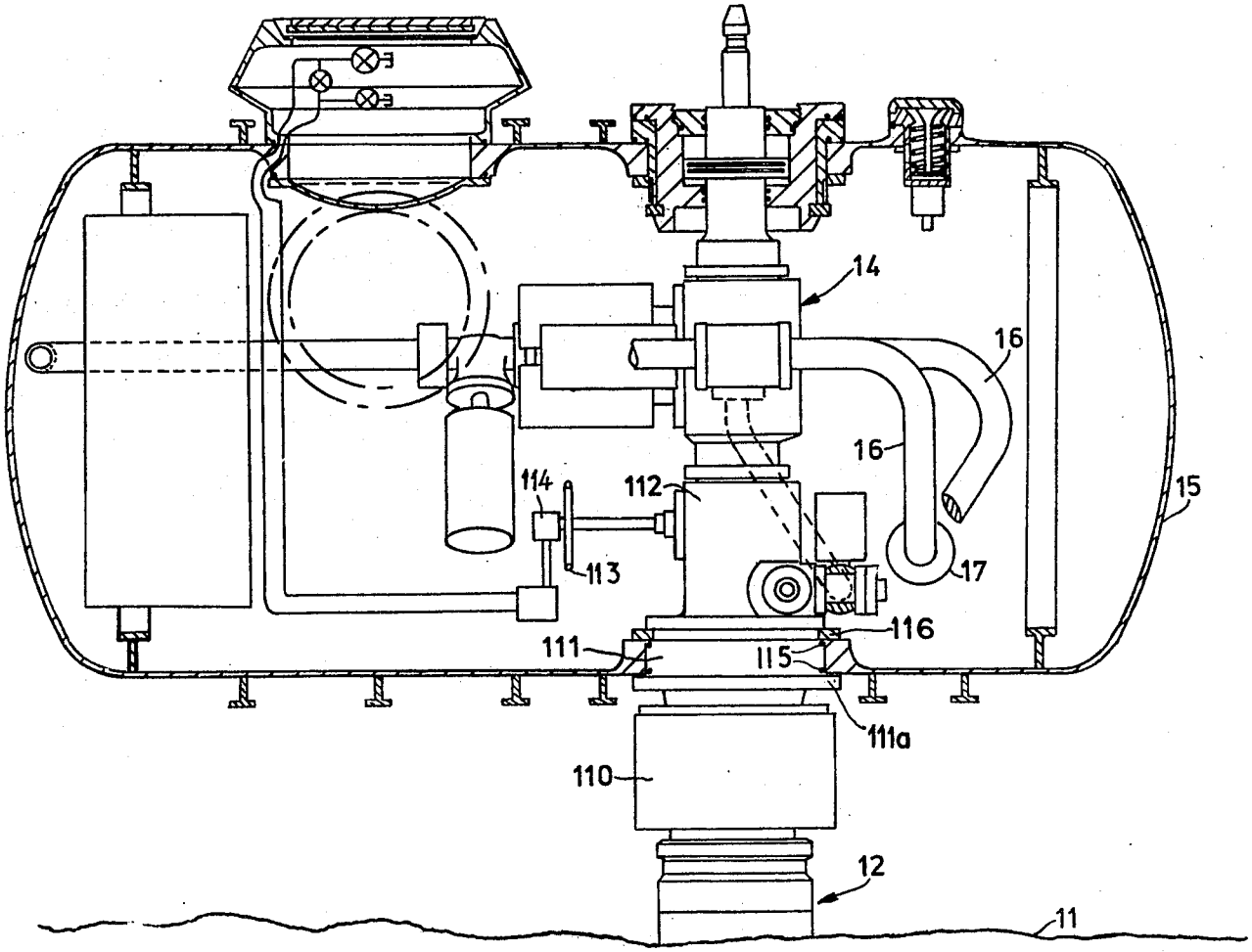
15
16
17
16
14
116
111a
115
12
11
112
113
114
111
110

SUB-SEA WELL HEADS

The present invention concerns sub-sea well-heads and is division of Patent application Ser. No. 685,676 filed 5/12/76.

A sub-sea gas- or oil-well comprises a hole lined with casings in which casings below sea-bed level there is a valve arranged to close to prevent leakage and contamination of the ocean. On top of these casings there is a connector mounting a so-called christmas tree. In the christmas tree there is a back-up or master valve. It has been proposed to enclose the entire well-head in a capsule. However in this proposal, if there is a fault between the two valves, the contents of the well-head between the two valves whilst insufficient seriously to pollute the ocean will probably escape into the confined space of the capsule and seriously impede operations on the christmas tree. Moreover if the first valve fails, there will be an increase of pressure and additional strains on the seals in the well-head when the master valve is closed tending to increase the risk of escape into the capsule. Since repair of the first valve would involve plugging the well by means introduced into the well through a lock-through arrangement associated with the christmas tree, it is desired to minimise contamination of the capsule by any leakage.

According to the present invention there is provided a well-head comprising a connector and a christmas tree having a capsule enclosing the christmas tree and a master valve within the christmas tree characterised in that the master valve is contained within a member forming the foot of the christmas tree, the member penetrating and being sealed into the bottom of the capsule and supporting the capsule, and in that the master valve is contained within a part of the member within the capsule.

An embodiment of the invention will now be described, by way of example, with reference to the accompanying drawing which is a vertical section through a capsule enclosing a christmas tree and showing a connector of a well-head.

In the FIGURE, from a portion of the sea-bed 11 project well-head casings 12 on which is mounted a christmas tree 14 enclosed in a sealed capsule 15. Pipes

16 are brought through suitable penetrations 17 in the wall of the capsule to connect up to the christmas tree. The well-head casings terminate in a connector 110 on which the christmas tree is mounted. The seals between the casings and the connector are outside the capsule so any leakage is outside the capsule. A member 111 forming the foot of the christmas tree is a solid block(in that it comprises a one-piece housing) and penetrates the bottom of the capsule and is sealed thereto by seals 115 as shown, the capsule is supported on a flange **111*a* of member 111 and is retained in place on the flange by a suitable securing ring 116, such as a split ring. The member 111 member contains in the part of the member within the capsule a master valve 112 operable by a handwheel 113 or by a hydraulic motor 114** controlled remotely by hydraulic means. The operating means are within the capsule. This member is of course sealed to the connector which is immediately below it but the seals are outside the capsule.

It will be appreciated that with this construction, any leakage into the capsule must be from the master valve member which can be designed to obviate any possibility of leakage; thus the capsule is not subject to contamination by leakage from the well-head.

I claim:

1. Means for mounting a pressure resistent capsule and a christmas tree contained within the capsule to a sub-sea wellhead with minimum leakage paths from said wellhead into said capsule, said capsule being of a size permitting the entrance of personnel thereinto for performing operations on said christmas tree, said means comprising a unitary member at the foot of the christmas tree penetrating the lower wall of the capsule and having a first part within the capsule containing a master valve and a second part extending exteriorily beyond the lower wall of said capsule, means sealingly supporting said capsule on said unitary member intermediate the first and second parts thereof, and a connector entirely exterior of said capsule connecting said wellhead and the second part of said unitary member whereby all leakage paths from the wellhead to the interior of the capsule are eliminated except by way of the master valve in the first part of said unitary member.

* * * * *